US006399150B1

(12) United States Patent
Yoshimura et al.

(10) Patent No.: US 6,399,150 B1
(45) Date of Patent: Jun. 4, 2002

(54) RARE EARTH METAL-BASED PERMANENT MAGNET, AND PROCESS FOR PRODUCING THE SAME

(75) Inventors: Kohshi Yoshimura, Hyogo; Takeshi Nishiuchi; Fumiaki Kikui, both of Osaka, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/492,742

(22) Filed: Jan. 27, 2000

(30) Foreign Application Priority Data

| | | |
|---|---|---|
| Jan. 27, 1999 | (JP) | 11-018426 |
| Apr. 23, 1999 | (JP) | 11-115835 |
| Apr. 23, 1999 | (JP) | 11-115836 |
| Jan. 11, 2000 | (JP) | 2000-002223 |

(51) Int. Cl.[7] ..... B05D 7/00
(52) U.S. Cl. ..... 427/242; 335/306
(58) Field of Search ..... 427/242; 335/302–306

(56) References Cited

U.S. PATENT DOCUMENTS

| | | | | |
|---|---|---|---|---|
| 5,273,782 A | * | 12/1993 | Sagawa et al. | 427/242 |
| 5,476,415 A | * | 12/1995 | Nishimura et al. | 451/326 |

FOREIGN PATENT DOCUMENTS

| | | | |
|---|---|---|---|
| EP | 0502475 A2 | | 9/1992 |
| JP | 4-237103 | * | 8/1992 |
| JP | 07302705 | | 11/1995 |
| JP | 8-186016 | | 7/1996 |
| JP | 09205013 | | 8/1997 |
| JP | 11003811 | | 1/1999 |
| JP | 11-195515 | | 7/1999 |
| JP | 11-233324 | | 8/1999 |
| WO | WO99/23675 | | 5/1999 |

OTHER PUBLICATIONS

European Search Report dated Apr. 13, 2000.

* cited by examiner

*Primary Examiner*—Lincoln Donovan
(74) *Attorney, Agent, or Firm*—Armstrong, Westerman & Hattori, LLP

(57) ABSTRACT

A rare earth metal-based permanent magnet has a film layer formed substantially of only a fine metal powder on a metal forming the surface of the magnet. The rare earth metal-based permanent magnet having the film layer on its surface is produced in the following manner: A rare earth metal-based permanent magnet and a fine metal powder forming material are placed into a treating vessel, where both of them are vibrated and/or agitated, whereby a film layer made of a fine metal powder produced from the fine metal powder producing material is formed on a metal forming the surface of the magnet. Thus, the formation of a corrosion-resistant film such as plated film can be achieved at a high thickness accuracy by forming an electrically conductive layer uniformly and firmly on the entire surface of the magnet without use of a third component such as a resin and a coupling agent.

4 Claims, No Drawings

RARE EARTH METAL-BASED PERMANENT MAGNET, AND PROCESS FOR PRODUCING THE SAME

BACKGROUND OF THE INVENTION

1. Field of the Invention

The present invention relates to a rare earth metal-based permanent magnet and a process for producing the same, wherein the formation of a corrosion-resistant film such as a plated film can be carried out at a high dimensional accuracy.

2. Description of the Related Art

A rare earth metal-based permanent magnet such as an R—Fe—B based permanent magnet represented by an Nd—Fe—B based permanent magnet is produced using a material which is rich in resources and inexpensive and has a high magnetic characteristic, as compared with an Sm—Co based permanent magnet. Therefore, particularly, the R—Fe—B based permanent magnet is used in a variety of fields at present.

In recent years, in electronic industries and appliance industries, a reduction in size of parts is advancing, and in correspondence to this, a reduction in size and a complication in shape of the magnet itself are required.

From this viewpoint, the public attention is paid to a bonded magnet easily formed from a magnetic powder and a resinous binder as main components. Such a bonded magnet is already put into practical use in various fields. However, the rare earth metal-based permanent magnet contains a rare earth metal R which is liable to be corroded by oxidation in the atmosphere. Therefore, when the rare earth metal-based permanent magnet is used without being subjected to a surface treatment, the corrosion advances from the surface of the magnet under the influence of a small amount of an acid, an alkali or water to generate a rust in the magnet, thereby bringing about the deterioration and dispersion of the magnetic characteristic. Further, when the magnet having a rust generated therein is incorporated in a magnetic circuit, it is feared that the rust is scattered to pollute the surrounding parts.

To solve this problem, an attempt has been made to form a plated film as a corrosion-resistant film on the surface of the magnet. However, when the bonded magnet is subjected directly to an electroplating treatment, a uniform and dense plated film cannot be formed, because the magnetic powder particles insulated by the resinous binder forming the surface of the magnet and the resin portion between the magnetic powder particles are lower in electric conductivity. As a result, pinholes (non-plated portions) may be produced to bring about a rust in some cases.

With the above point in view, various processes have been proposed in which an electric conductivity is provided to the entire surface of the bonded magnet, and the bonded magnet is subjected to an electroplating treatment.

For example, Japanese Patent Application Laid-open No.5-302176 describes a process which involves placing a bonded magnet, a resin which is at least in a partially uncured state, an electrically conductive powder and a film forming medium such as steel balls into a vessel, where a resinous film including the conductive powder is formed on the surface of the magnet by vibrating the vessel or by agitating the contents of the vessel, and forming a plated film on the resulting surface.

Japanese Patent Application Laid-open No.7-161516 describes a process which involves forming an uncured resinous layer on the whole or a portion of the surface of a bonded magnet, then forming an electrically conductive layer of a metal powder on the surface of the resinous layer using copper balls which are media for a vibrated-type ball mill, and further forming a plated film on the surface of the conductive layer.

Japanese Patent Application Laid-open No.11-3811 describes a process which involves immersing a bonded magnet into a solution of a coupling agent containing a metal powder added thereto, thereby adhering the metal powder to the surface of the magnet, coating the metal powder onto the surface of the magnet in a filled manner by a striking force of blast media such as stainless balls, and then forming a plated film on the resulting surface.

Further, Japanese Patent Application Laid-open No.8-186016 describes a process which involves coating a mixture of a resin and an electrically conductive material powder onto the surface of a bonded magnet to form an electrically conductive film layer, subjecting the magnet to a surface smoothing treatment, and forming a plated film on the resulting surface.

The following processes have been proposed as a method for forming a corrosion-resistant film other than a plated film on the surface of a bonded magnet:

For example, Japanese Patent Application Laid-open No.7-302705 describes a process which involves coating the surface of a bonded magnet with an uncured resin, placing the resulting magnet into a vessel along with a metal powder and film forming media such as balls made of alumina, and adhering the metal powder onto the surface of the uncured resin by vibrating the vessel and/or by agitating the contents of the vessel, thereby forming a chromate film on the resulting surface.

Japanese Patent Application Laid-open No.10-226890 describes a process which involves immersing a bonded magnet into a solution of a coupling agent containing a metal powder added thereto, thereby previously depositing the metal powder onto the surface of the magnet, adhering the metal powder by blast media such as stainless balls, and forming a resinous film on the resulting surface.

Japanese Patent Application Laid-open No.9-205013 describes a process which involves filling a metal powder into the voids in the surface of a bonded magnet by an attacking force of blast media such as steel balls, and forming a resinous film on the resulting surface.

The processes described in Patent Application Laid-open No.5-302176, 7-161516, 11-3811 and 8-186016 basically provide an electrical conductivity to the entire surface of the bonded magnet, using the metal powder. Even by the processes described in Patent Application Laid-open Nos.7-302705 and 10-226890, an electrical conductivity can be provided to the entire surface of the bonded magnet. However, each of these processes is intended to adhere the metal powder onto the surface of the magnet by utilizing the stickiness of the third component such as the resin and the coupling agent. In such processes, an increase in cost is brought about, because the third component is required. In addition, it is difficult to form the electrically conductive layer uniformly on the entire surface of the magnet and as a result, it is difficult to achieve the surface treatment at a high dimensional accuracy. Additionally, a step of curing the uncured resin is required, resulting in a complicated producing process. Further, when media such as steel balls, copper balls, stainless balls or alumina balls are used as a metal powder adhering means, it is feared that cracking or chipping of the bonded magnet are brought about.

According to the process described in Patent Application Laid-open No.9-205013, the metal powder can be filled in the voids in the surface of the magnet without use of a third component such as a resin and a coupling agent. However, this process is not intended to adhere the metal powder on the magnetic powder forming the surface of the magnet. Therefore, even if the metal powder is adhered on the magnetic powder, the adhering force is necessarily weak and hence, it is impossible to adhere the metal powder onto the magnetic powder. In addition, a step of removing the surplus metal powder weakly adhered to the magnetic powder by washing is required in this process and hence, the complication of the producing process is brought about.

SUMMARY OF THE INVENTION

Accordingly, it is an object of the present invention to provide a rare earth metal-based permanent magnet and a process for producing the same, wherein the formation of a corrosion-resistant film such as a plated film can be carried out at a high thickness accuracy by forming an electrically conductive layer uniformly and firmly onto the entire surface of a magnet without use of a third component such as a resin and a coupling agent.

The present inventors have made various studies by paying attention to a mechanochemical reaction which is a specific surface chemical reaction caused by a pure metal surface (a fresh surface) which is not oxidized. As a result, they found that when a rare earth metal-based permanent magnet and a fine metal powder producing material are placed into a treating vessel, where both of the permanent magnet and the fine metal powder producing material are vibrated and/or agitated, a fine metal powder having a fresh surface is produced from the fine metal powder producing material, and a film layer made of the fine metal powder is formed firmly at a high density on the metal forming the surface of the magnet.

The present invention has been accomplished with the above knowledge in view, and to achieve the above object, according to a first aspect and feature of the present invention, there is provided a rare earth metal-based permanent magnet which has a film layer made substantially of only a fine metal powder directly on a metal forming the surface of the magnet.

According to a second aspect and feature of the present invention, in addition to the first feature, the fine metal powder contains at least one metal component selected from copper (Cu), iron (Fe), cobalt (Co), nickel (Ni) and chromium (Cr).

According to a third aspect and feature of the present invention, in addition to the first feature, the fine metal powder is a fine copper (Cu) powder.

According to a fourth aspect and feature of the present invention, in addition to the first feature, the fine metal powder has a Vickers hardness value of 60 or less.

According to a fifth aspect and feature of the present invention, in addition to the first feature, the fine metal powder contains at least one metal component selected from Sn, Zn, Pb, Cd, In, Au, Ag and Al.

According to a sixth aspect and feature of the present invention, in addition to the first feature, the fine metal powder is a fine aluminum powder.

According to a seventh aspect and feature of the present invention, in addition to the first feature, the rare earth metal-based permanent magnet is an R—Fe—B based permanent magnet.

According to an eighth aspect and feature of the present invention, in addition to the second feature, the rare earth metal-based permanent magnet is a bonded magnet, and the resinous portion of the surface of the magnet is coated with a film layer made of a fine metal powder which contains at least one metal component selected from Cu, Fe, Ni, Co and Cr.

According to a ninth aspect and feature of the present invention, in addition to the fourth feature, the rare earth metal-based permanent magnet is a bonded magnet, and the resinous portion of the surface of the magnet is coated with a film layer made of a fine metal powder having a Vickers hardness value of 60 or less.

According to a tenth aspect and feature of the present invention, in addition to the second feature, the film layer has a thickness in a range of 0.001 $\mu$m to 0.2 $\mu$m.

According to an eleventh aspect and feature of the present invention, in addition to the fourth feature, the film layer has a thickness in a range of 0.001 $\mu$m to 100 $\mu$m.

According to a twelfth aspect and feature of the present invention, in addition to the first feature, the particles of the fine metal powder have a longer diameter in a range of 0.001 $\mu$m to 5 $\mu$m.

According to a thirteenth aspect and feature of the present invention, there is provided a process for producing a rare earth metal-based permanent magnet, comprising the step of placing a rare earth metal-based permanent magnet and a fine metal powder producing material into a treating vessel, and vibrating and/or agitating both of the permanent magnet and the fine metal powder producing material in the treating vessel, thereby forming a film layer made of a fine metal powder produced from the fine metal powder producing material on a metal forming the surface of the magnet.

According to a fourteenth aspect and feature of the present invention, in addition to the thirteenth feature, the treating vessel is a treating vessel in a barrel finishing machine.

According to a fifteenth aspect and feature of the present invention, in addition to the thirteenth feature, the treatment is carried out in a dry manner.

According to a sixteenth aspect and feature of the present invention, in addition to the thirteenth feature, the fine metal powder producing material is of a needle-like shape and/or a columnar shape having a longer diameter in a range of 0.05 mm to 10 mm.

According to a seventeenth aspect and feature of the present invention, there is provided a rare earth metal-based permanent magnet having a film layer made of a fine metal powder on a metal forming the surface of the magnet, wherein the magnet is produced by placing a rare earth metal-based permanent magnet and a fine metal powder producing material into a treating vessel, and vibrating and/or agitating both of the permanent magnet and the fine metal powder producing material in the treating vessel.

According to an eighteenth aspect and feature of the present invention, in addition to the first or seventeenth feature, the rare earth metal-based permanent magnet has a plated film on its surface.

According to an nineteenth aspect and feature of the present invention, in addition to the first or seventeenth feature, the rare earth metal-based permanent magnet has a metal oxide film on its surface.

According to an twentieth aspect and feature of the present invention, in addition to the first or seventeenth feature, the rare earth metal-based permanent magnet has a chemical conversion coating film on its surface.

In the rare earth metal-base permanent magnet according to the present invention, the film layer made substantially of only the fine metal powder is formed firmly at a high density on the metal forming the surface of the magnet. Further, when the present invention is applied to the bonded magnet, the already cured resin portion of the surface of the magnet can be also coated with the film layer made of the fine metal powder and hence, the electrically conductive layer can be formed uniformly and firmly on the entire surface of the magnet without use of a third component such as a resin and a coupling agent. Therefore, the formation of the film excellent in corrosion resistance can be achieved at a high thickness accuracy by the electroplating treatment or the like, leading to an enhancement in dimensional accuracy of the magnet. The film layer made of the fine metal powder has a rust-proofing effect and hence, the film layer itself performs a role as a rust-proofing layer.

DETAILED DESCRIPTION OF THE INVENTION

The present invention is intended for rare earth metal-based permanent magnets having various configurations such as bonded magnets made by bonding a magnetic powder by a required binder, and sintered magnets made by sintering a magnetic powder. In the prior art, it requires a third component such as a resin and a coupling agent in order to provide an electrical conductivity to the entire surface of a bonded magnet, but in according to the present invention, an electrical conductivity can be provided to the entire surface of a bonded magnet without use of such a third component. Therefore, the present invention is effective particularly for a bonded magnet.

It should be noted that the bonded magnet may be either a magnetically isotropic bonded magnet or a magnetically anisotropic bonded magnet, if it is made using a magnetic powder and a resinous binder as main components. In addition, the bonded magnet may be a bonded magnet made by bonding a magnetic powder by a metal binder or an inorganic binder in addition to the resinous binder, and in this case, a filler may be contained in the binder.

There are conventionally known rare earth metal-based bonded magnets having various compositions and various crystal structures, and the present invention is intended for all of these bonded magnets.

Examples of such bonded magnets are an anisotropic R—Fe—B based bonded magnet as described in Japanese Patent Application Laid-open No.9-92515, an Nd—Fe—B based nanocomposite magnet having a soft magnetic phase (e.g., an α-Fe phase and an $Fe_3B$ phase) and a hard magnetic phase (e.g., an $Nd_2Fe_{14}B$ phase) as described in Japanese Patent Application Laid-open No.8-203714, and a bonded magnet made using an isotropic Nd—Fe—B based magnetic powder (e.g., a powder made by MQI Co., under a trade name of MQP-B) produced by a melt quenching process used conventionally and widely.

Another example is an R—Fe—N based bonded magnet described in Japanese Patent Publication No.5-82041 and represented by $(Fe_{1-x}R_x)_{1-y}N_y$ wherein $0.07 \leqq x \leqq 0.3$ and $0.001 \leqq y \leqq 0.2$.

The effect of the present invention does not vary depending on the composition and the crystal structure of the magnetic powder forming the bonded magnet and the isotropy and anisotropy of the bonded magnet. Therefore, the intended effect can be obtained in any of the above-described bonded magnets.

The magnetic powder forming the bonded magnet can be produced by a process such as a dissolution and milling process which comprises melting a rare earth metal-based permanent magnet alloy, subjecting it to a casting treatment to produce an ingot, and pulverizing the ingot; a sintered-product pulverizing process which comprises producing a sintered magnet and then pulverizing the sintered magnet; a reduction and diffusion process which produces a magnetic powder directly by Ca reduction; a rapid solidification process which comprises producing a ribbon foil of a rare earth metal-based permanent magnet alloy by a melting jet caster, and pulverizing and annealing the ribbon foil; an atomizing process which comprises melting a rare earth metal-based permanent magnet alloy, powdering the alloy by atomization and subjecting the powdered alloy to a heat treatment; and a mechanical alloying process which comprises powdering a starting metal, finely pulverizing the powdered metal and subjecting the finely pulverized metal to a heat treatment.

In addition to the above-described process, the magnetic powder forming the R—Fe—N based bonded magnet can be produced by any process such as a gas nitrided process which comprises pulverizing a rare earth metal-based permanent magnet alloy, nitriding the pulverized alloy in an atmosphere of nitrogen gas or ammonia gas, and finely pulverizing the resulting alloy.

Various processes will be described below with the production of a magnetic powder for an R—Fe—B based bonded magnet being taken as an example.

(Dissolution and Milling Process)

This is a producing process including the steps of melting a starting material, subjecting the molten material to a casting to produce an ingot and mechanically pulverizing the ingot. For example, a starting material is a powder which comprises ferroboron alloy containing electrolytically produced iron, boron, the balance of Fe and impurities of Al, Si, C or the like, a rare earth metal, or further containing electrolytically produced cobalt. The starting powder is subjected to a high frequency dissolution followed by casting in water-cooled casting copper mold. The resulting ingot is pulverized in a hydrogen occlusion manner, or coarsely pulverized by a usual mechanically pulverizing device such as a stamp mill. Then, the coarsely pulverized material is pulverized finely by a dry pulverizing method using a ball mill or a jet mill, or by a wet pulverizing method using any of various solvent.

With such process, it is possible to produce a fine powder comprising a substantially single crystal or several crystal grains and having an average particle size in a range of 1 μm to 500 μm.

A magnetic powder having a high coercive force can be produced by forming a fine powder having a required composition and an average particle size of 3 μm or less in an oriented manner in the presence of a magnetic field, disintegrating the fine powder, subjecting the disintegrated powder to a heat treatment at a temperature in a range of 800° C. to 1,100° C., and further disintegrating the resulting powder.

(Sintered-product Pulverizing Process)

This is a process which comprises sintering a required R—Fe—B based alloy and pulverizing the sintered product again to produce a magnetic powder. For example, a starting material is a powder which comprises ferroboron alloy containing electrolytically produced iron, boron, the balance of Fe and impurities of Al, Si, C or the like, a rare earth metal, or further containing electrolytically produced cobalt. The starting powder is alloyed by a high frequency dissolution or the like in an inert gas atmosphere, and coarsely pulverized using a stamp mill or the like and further finely pulverized by a ball mill or the like. The produced fine powder is subjected to a pressure molding in the presence or absence of a magnetic field, and the molded product is sintered in vacuum or in an inert gas atmosphere which is a non-oxidizing atmosphere. The sintered product is pulverized again to produce a fine powder having an average particle size in a range of 0.3 μm to 100 μm. Thereafter, the fine powder may be subjected to a heat treatment at a temperature in a range of 500° C. to 1,000° C. in order to increase the coercive force.

(Reduction and Diffusion Process)

A starting powder comprising at least one metal powder selected from a ferroboron powder, a ferronickel powder, a cobalt powder, an iron powder and a rare earth metal oxide powder, and/or an oxide powder, is selected depending on the composition of a desired starting alloy powder. Metal calcium (Ca) or $CaH_2$ is mixed with the starting powder in an amount 1.1 to 4.0 times (by weight) a stoichiometrically required amount required for the reduction of the rare earth metal oxide. The mixture is heated to a temperature in a range of 900° C. to 1,200° C. in an inert gas atmosphere, and the resulting reaction product is thrown into water, whereby a by-product is removed, thereby providing a powder which has an average particle size in a range of 10 μm to 200 μm and which is not required to be coarsely pulverized. The produced powder may be further pulverized finely by a dry pulverization using a ball mill, a jet mill or the like.

A magnetic powder having a high coercive force can be produced by forming a fine powder having a required composition and an average particle size of 3 μm or less in an oriented manner in the presence of a magnetic field, disintegrating the fine powder, subjecting the disintegrated powder to a heat treatment at a temperature in a range of 800° C. to 1,100° C., and further disintegrating the resulting powder.

(Rapid Solidification Process)

A required R—Fe—B based alloy is dissolved and subjected to a melt-spin in a jet caster to produce a ribbon foil having a thickness on the order of 20 μm. The ribbon foil is pulverized and subjected to an annealing treatment to provide a powder having fine crystal grains of 0.5 μm or less.

The powder produced from the ribbon foil and having the fine crystal grains is subjected to a hot pressing and a die upsetting treatment to produce a bulk magnet having an anisotropy. The bulk magnet may be pulverized finely.

(Atomizing Process)

This is a process which comprises dissolving a required R—Fe—B based alloy, dropping the molten alloy from a fine nozzle, atomizing the molten alloy at a high speed by an inert gas or a liquid, subjecting the atomized alloy to a sieving or a pulverization, and then subjecting the resulting material to a drying treatment or an annealing treatment to produce a magnetic powder.

The powder having fine crystal grains is subjected to a hot pressing and a die upsetting treatment to produce a bulk magnet having an anisotropy. The bulk magnet may be pulverized finely.

(Mechanical Alloying Process)

This is a process which comprises mixing and converting a required starting powder to an amorphous structure at an atomic level in an inert gas atmosphere by a ball mill, a vibrating mill, a dry attriter or the like, and subjecting the resulting powder to an annealing treatment to produce a magnetic powder.

The powder having fine crystal grains is subjected to a hot pressing and a die upsetting treatment to produce a bulk magnet having an anisotropy. The bulk magnet may be pulverized finely.

Examples of processes which are capable of providing a magnetic anisotropy to the bulk magnet or the magnetic powder and which may be used, are a hot pressing and pulverizing process (see Japanese Patent Publication No.4-20242) which comprises sintering an alloy powder produced by a rapid solidification process at a low temperature by a hot press or the like, and pulverizing the bulk magnet having a magnetic an isotropy provided by a die upsetting treatment; a pack rolling process (see Japanese Patent No.2596835) which comprises filling an alloy powder produced by a rapid solidification process, as it is, into a vessel made of a metal to provide a magnetic anisotropy to the alloy powder by a plastic working such as a hot rolling; an ingot hot pressing and pulverizing process (Japanese Patent Publication No.7-66892) which comprises subjecting an alloy ingot to a hot plastic working and then pulverizing the resulting ingot to produce a magnetic powder having a magnetic anisotropy; and an HDDR process (see Japanese Patent Publication No.6-82755) which comprises heating a rare earth metal-based permanent magnet alloy in a hydrogen atmosphere to occlude hydrogen, subjecting the magnetic alloy to a dehydrogenating treatment and cooling the resulting alloy, thereby producing a magnetic powder.

The process for providing the magnetic anisotropy is not limited to those using the combinations of the starting alloys and the anisotropy providing means, and various proper combinations can be used.

Examples of the compositions of the magnetic powders produced by the above-described processes are a composition comprising 8% by atom to 30% by atom of R (R is at least one of rare earth elements including Y, desirably, of light rare earth elements such as Nd, Pr as a main component and the like, or a mixture of at least one of rare earth elements with Nd, Pr or the like), 2% by atom to 28% by atom of B (a portion of B may be substituted by C), and 65% by atom to 84% by atom of Fe (a portion of Fe may be substituted by at least one of Co in an amount of 50% or less of Fe and Ni in an amount of 8% or less of Fe).

To increase the coercive force and the corrosion resistance of the bonded magnet, at least one of the following elements may be incorporated into the starting powder: 3.5% by atom or less of Cu, 2.5% by atom or less of S, 4.5% by atom or less of Ti, 15% by atom or less of Si, 9.5% by atom or less of V, 12.5% by atom or less of Nb, 10.5% by atom or less of Ta, 8.5% by atom or less of Cr, 9.5% by atom or less of Mo, 9.5% by atom or less of W, 3.5% by atom or less of Mn, 9.5% by atom or less of Al, 2.5% by atom or less of Sb, 7% by atom or less of Ge, 3.5% by atom or less of Sn, 5.5% by atom or less of Zr, 5.5% by atom or less of Hf, 8.5% by atom or less of Ca, 8.5% by atom or less of Mg, 7% by atom or less of Sr, 7% by atom or less of Ba, 7% by atom or less of Be and 10% by atom or less of Ga.

For the magnetic powder for an Nd—Fe—B based nanocomposite magnet, it is desirable to select a composition in a range comprising 1% by atom to 10% by atom of R, 5% by atom to 28% by atom of B and the balance comprising substantially Fe.

When a resinous binder is used as a binder for producing a bonded magnet, a resin suitable for each of the molding processes may be used. For example, examples of the resins suitable for a compression molding process are an epoxy resin, a phenol resin, diallyl phthalate and the like. Examples of the resins suitable for an injection molding process are 6-nylon, 12-nylon, polyphenylene sulfide, polybutylene phthalate and the like. Examples of the resins suitable for an extrusion process and a rolling process are polyvinyl chloride, an acrylonitrile-butadiene rubber, chlorinated polyethylene, natural rubbers, Hypalon and the like.

Various processes for producing a bonded magnet are known, and examples of the processes commonly used are an injection molding process, an extruding process, a rolling process and the like in addition to a compression molding process which comprises mixing a magnetic powder, a resinous binder and as required, a silane-based or titanium-based coupling agent, a lubricant for facilitating the molding, and a binding agent for a resin and an inorganic filler in required amounts to knead the mixture, subjecting the mixture to a compression molding, and heating the resulting material to cure the resin.

The present invention is also applicable to a sintered magnet. As in the above-described bonded magnets, examples of the sintered magnets are an R—Fe—B based sintered magnet, typical of which is an Nd—Fe—B based sintered magnet, an R—Fe—N based sintered magnet, typical of which is an Sm—Fe—B based sintered magnet, and the like.

A magnetic powder which is a starting material for the sintered magnet can be produced by a process similar to that for producing the magnetic powder for forming the bonded magnet, e.g., a dissolution and milling process and a reduction and diffusion process and the like which are conventionally employed. In addition to these processes, particularly, a sintered magnet having a high magnetic characteristic can be produced using a magnetic powder which is produced by pulverizing a thin alloy plate having a columnar crystal structure grown in a thickness-wise direction by a molten metal quenching process, and which is described in Japanese Patent No.2665590.

The composition of the magnetic powder which is a starting material for the sintered magnet can be selected in a range substantially similar to that of the magnetic powder for forming the bonded magnet.

The sintered magnet can be easily produced by employing the known powder metallurgical process. The provision of an anisotropy can be realized by molding a magnetic powder having a magnetic anisotropy in an oriented manner in the presence of a magnetic field.

Even in these sintered magnets, the effect of the present invention is not varied depending on the composition of the magnetic powder as the starting material and the isotropy and anisotropy of the sintered magnet, and an intended effect can be obtained, as in the bonded magnet.

The term "metal forming the surface of the magnet" used in the present invention means, in addition to a magnetic powder existing in the surface of a bonded magnet, a metal filler existing in the surface of a bonded magnet produced using a binder including the metal filler, a magnetic crystal phase existing in the surface of a sintered magnet, and the like.

Thus, the form and quality of the metal forming the surface of the magnet are particularly not limited, if the fine metal powder can be adhered firmly to the metal by a mechanochemical reaction, and the effect provided is not varied largely depending on the form and quality of the metal. The present invention is intended for all of the metals causing the generation of a rust by the oxidation and corrosion in the surface of the magnet. Therefore, even if the existing form and configuration form of the metal forming the surface of the magnet are varied depending on the magnet producing process, they are not limited by Examples which will be described hereinafter, if the fine metal powder can be adhered firmly to the metal by the mechanochemical reaction.

Examples of the fine metal powders are a powder comprising a metal component such as Cu, Fe, Ni, Co, Cr and the like, a powder which comprises a metal component having a large ductility, for example, Sn, Zn, Pb, Cd, In, Au, Ag, Al and the like, and which has a Vickers hardness value of 60 or less. The Vickers hardness is one of the indexes indicating the hardness of a material, and a test for measuring the Vickers hardness can be carried out, for example, according to a Vickers hardness testing process (JISZ2244) using a Vickers hardness testing machine (JISB7725).

The fine metal powder may comprise a single metal component, or an alloy containing two or more metal components. The fine metal powder may comprise an alloy containing these metal components as main components and another metal component. When such an alloy is used, it is desirable to select an appropriate combination of the metal components depending on, for example, a required ductility. The fine metal powder may contain impurities inevitable in the industrial production.

According to the present invention, a film layer made of a fine metal powder is formed efficiently on a metal forming the surface of a rare earth metal-based permanent magnet by utilizing a mechanochemical reaction which is a specific surface chemical reaction caused by a fresh surface of a metal. The film layer formed by the mechanochemical reaction is formed firmly and at a high density on the metal forming the surface of the magnet and hence, cannot be removed by only rubbing the surface by hand. Therefore, the film layer cannot be peeled off during various handling steps such as a washing step after the formation of the film layer till the completion of an electroplating treatment. Thus, an electrically conductive layer can be formed uniformly and firmly on the entire surface of the magnet without use of a third component such as a resin and a coupling agent and hence, a plated film having a high adhesion strength can be formed at a high thickness accuracy.

The film layer formed on the metal forming the surface of the magnet is formed from a fine metal powder maintaining a shape immediately after being produced from a fine metal powder producing material, a fine metal powder adhered to the metal forming the surface of the magnet and deformed (e.g., stretched) by collision against the contents (most of which is the fine metal powder producing material) of the treating vessel, a fine metal powder deformed after being adhered onto a fine metal powder, an aggregate of fine metal powders, a product resulting from the deformation of the aggregate (e.g., a scale-like product resulting from stretching of the aggregate), a laminate of the aggregate and the like. Therefore, the film layer made of the fine metal powder in the present invention means a film layer formed using a fine metal powder produced from a metal powder producing material as a forming source.

The mechanochemical reaction is a reaction caused by the fresh surface of the metal, as described above and hence, it is important that how the fresh surface of the metal is produced. According to the present invention, this purpose can be achieved by placing a rare earth metal-based permanent magnet and a fine metal powder producing material into a treating vessel, and vibrating and/or agitating both of the permanent magnet and the fine metal powder producing material in the treating vessel. The mechanism thereof is as follows: First, a fine metal powder is produced from the fine metal powder producing material by vibration and/or agitation of the rare earth metal-based permanent magnet and the fine metal powder producing material. It should be noted that the fine metal powder as just produced is not oxidized and has a fresh surface. Further, it should be also noted that according to the above-described operation, a fresh surface can be produced on the metal forming the surface of the magnet, on the fine metal powder adhered onto the metal forming the surface of the magnet and the like, by collision against the contents of the treating vessel. As a result, it is believed that the fresh surface is very advantageous for continuously causing the mechanochemical reaction.

It has been ascertained that even if a commercially available fine metal powder is placed into the treating vessel in place of the fine metal powder producing material and the same operation is carried out with a commercially available fine metal powder being placed into the treating vessel in place of the fine metal powder producing material, it is failed to adhere the fine metal powder to the metal forming the surface of the magnet. The reason is considered to be as follows: The commercially available fine metal powder usually has an oxidized surface and does not have a fresh surface and in addition, does not have a sharp end. For this reason, a fresh surface cannot be produced efficiently on the metal forming the surface of the magnet by the collision of the fine metal powder against the metal forming the surface of the magnet, and a fresh surface cannot be produced by the collision of the fine metal powder particles against one another and by the collision of the fine metal powder particles against the metal forming the surface of the magnet.

Examples of the fine metal powder producing materials as a source for producing a fine metal powder having a fresh surface, which may be used, are a metal piece made of only a desired metal, and a composite metal piece comprising a desired metal coated on a core material made of a different metal. These metal pieces have a variety of shapes such as a needle-like shape (wire-like shape), a columnar shape, a massive shape and the like. However, it is desirable to use a metal piece with a sharp end, for example, a metal piece having a needle-like shape and a metal piece having a columnar shape, from the viewpoints of the purpose of efficiently producing a fine metal powder and the purpose of efficiently producing a fresh surface on the metal forming the surface of the magnet. Such a desirable shape can be easily provided by employing a known wire cutting technique.

The size (longer diameter) of the fine metal powder producing material is desirable to be in a range of 0.05 mm to 10 mm, more desirable to be in a range of 0.3 mm to 5 mm, further desirable to be in a range of 0.5 mm to 3 mm from the viewpoints of the purpose of efficiently producing a fine metal powder and the purpose of effectively producing a fresh surface on the metal forming the surface of the magnet. The fine metal powder producing material, which may be used, is a material having the same shape and the same size, and a mixture of materials having different shapes and different sizes.

It is as described above that a fine metal powder cannot be adhered onto the metal forming the surface of the magnet by use of only the commercially available fine metal powder. However, if the commercially available fine metal powder is placed into the treating vessel in combination with the above-described fine metal powder producing material, a fresh surface can be produced even on the commercially available fine metal powder by the collision of the powder against the fine metal powder producing material or the like. Therefore, it is expected that such commercially available fine metal powder also contributes to the formation of the film layer.

The treating vessel used in the present invention is particularly not limited, and may be any vessel, if it is capable of vibrating and/or agitating the rare earth metal-based permanent magnet and the fine metal powder producing material. Examples of particular treating vessels are a treating vessel in a barrel finishing machine used for working the surface of a work-piece, a treating vessel in a ball mill used for milling a work-piece and the like. A bonded magnet or the like, which is not high in strength of the magnet itself, is cracked or chipped if a strong shock is applied to the magnet and hence, it is desirable from this viewpoint to use the treating vessel in the barrel finishing machine. The barrel finishing machines which may be used are known machines of a rotary-type, a vibrating-type, a centrifugal-type and the like. In the case of the rotary-type, it is desirable that the rotational speed is in a range of 20 rpm to 50 rpm. In the case of the vibrating-type, it is desirable that the vibration frequency is in a range of 50 Hz to 100 Hz, and the amplitude of vibration is in a range of 0.3 mm to 10 mm. In the case of the centrifugal-type, it is desirable that the rotational speed is in a range of 70 rpm to 200 rpm.

It is desirable that the vibration and/or agitation of the rare earth metal-based permanent magnet and the fine metal powder producing material are carried out in a dry manner in consideration of the fact that both of them are liable to be corroded by oxidation. It is desirable that the total amount of the rare earth metal-based permanent magnet and the fine metal powder producing material is in a range of 20% by volume to 90% by volume of the internal volume of the treating vessel. If the total amount is lower than 20% by volume, the throughput is too small, which is not preferred for practical use. If the total amount exceeds 90% by volume, it is feared that the adhesion of the fine metal powder to the magnet does not occur efficiently. The ratio of the rare earth metal-based permanent magnet to the fine metal powder producing material which are thrown into the treating vessel is desirable to be equal to or smaller than 3 in terms of a ratio by volume (of magnet/fine metal powder producing material). If the ratio exceeds 3, a long time is required for the adhesion of the fine metal powder to surface of the magnet, which is not preferred for practical use and in addition, it is feared that the collision of the magnets against one another occurs frequently, thereby causing the cracking of the magnet, the removal of magnetic powder particles from the surface of the magnet and the like. The treating time depends on the throughput, but is generally in a range of about 1 hour to about 10 hours.

When the above-described operation is carried out for the bonded magnet, a pre-treating step may be carried out such as a closing treatment for pores using an inorganic powder such as aluminum oxide, and a surface smoothing treatment using vegetable skin refuse, sawdust, paddy, wheat bran, fruit shell, corncob, an abrasive stone and the like.

The fine metal powders produced from the fine metal powder producing material are of various sizes and shapes, but in general, an ultra-fine powder (particles having a longer diameter in a range of 0.001 $\mu$m to 0.1 $\mu$m) is advantageous for causing the mechanochemical reaction. A fine powder comprising a metal component such as Cu, Fe, Ni, Co, Cr, etc., forms a firm and high-density film layer having a thickness in a range of 0.001 $\mu$m to 0.2 $\mu$m on the metal forming the surface of the magnet. A fine powder comprising a metal component having a large ductility, for example, Sn, Zn, Pb, Cd, In, Au, Ag, Al, etc., and which has a Vickers hardness value of 60 or less, forms a firm and high-density film layer in such a manner that an aggregate of fine powders is laminated. Therefore, if the treating time is prolonged, a film layer having a thickness on the order of 100 $\mu$m can be formed. However, in order to provide a sufficient electric conductivity to the surface of the magnet and to meet the demand for a reduction in size of the magnet, it is desirable that the thickness of the film layer is in a range of 0.001 μm to 1 μm.

When the present invention is applied to the bonded magnet, the relatively large particles (particles having a longer diameter on the order of 5 μm) of the fine metal powder produced are press-fitted into a already-cured resin portion of the surface of the magnet, and a portion protruding on the resin is deformed into a shape covering the resin surface by the collision against the contents of the treating vessel to contribute to the formation of the film layer covering the entire surface of the resin surface. Therefore, the film layer made of the fine metal powder is formed not only on metal forming the surface of the magnet, but also on the already cured resin of the surface of the magnet and hence, an electrically conductive layer can be provided uniformly and firmly on the entire surface of the magnet.

The rare earth metal-based permanent magnet having an electrical conductivity provided to the entire surface of the magnet in the above manner can be subjected to a known electroplating treatment. Moreover, it is unnecessary to form an electrically conductive layer containing a third component such as a resin and a coupling agent and hence, a plated film can be formed at a high thickness accuracy on the surface of the magnet. Therefore, it is possible to enhance the dimensional accuracy of the magnet after the formation of the plated film by employing the configuration of the present invention.

When the ring-shaped bonded magnet having the plated film and produced in the above manner is utilized in a motor, the magnetic characteristic of the magnet itself can be utilized effectively to the maximum to provide an enhancement in energy efficiency. It is also possible to provide a reduction in size of the motor. The plated film can be formed on the surface of the film layer made of any fine metal powder, but a film layer formed using a fine Cu powder is preferred in respect of the ease of an Ni electroplating process and cost.

The film layer made of the fine metal powder formed by the mechanochemical reaction is formed firmly and at a high density on the metal forming the surface of the magnet and hence, the film layer itself has an effect of preventing the rusting of the magnet. In order to provide a high corrosion resistance, it is of course necessary to carry out an electroplating treatment or the like. However, for a magnet having a corrosion resistance which may be guaranteed up to a point in time of the completion of the production of apart, the present invention has a sufficient industrial value provided by an effect of the film layer itself serving as an anticorrosive layer on the magnet, as for a resin-embedded type magnet for a motor. An oxide film can be formed on a film layer made of an fine Al powder to provide an excellent anticorrosive effect and hence, the fine Al powder is desirable in respect of simple anticorrosion as described above.

A typical electroplating process for forming a plated film on the surface of the magnet is a plating process using at least one metal selected from, for example, Ni, Cu, Sn, Co, Zn, Cr, Ag, Au, Pb, Pt, etc., or an alloy of such metals (which may contain B, S and/or P). A plating process using another metal or alloy in combination with the above-described metals may be employed depending on the application. The thickness of the plated film is equal to or smaller than 50 μm, desirably, in a range of 10 μm to 30 μm.

In carrying out an Ni electroplating treatment, it is desirable that a washing step, an Ni electroplating step, a washing step and a drying step are conducted sequentially in the named order. Any one of various plating bath tanks may be used depending on the shape of the magnet. For example, in the case of a bonded magnet having a ring-like shape, it is desirable that a rack plating type or a barrel plating type is used. A known plating bath may be used such as a Watt's bath, a nickel sulfamate bath, a Wood's bath and the like. An electrolytic Ni plate is used as an anode, but it is desirable that an S-containing estrand nickel chip is used as the electrolytic Ni plate in order to stabilize the elution of nickel (Ni).

In carrying out a Cu electroplating treatment, it is desirable that a washing step, a Cu electroplating step, a washing step and a drying step are conducted sequentially in the named order. Any one of various plating bath tanks may be used depending on the shape of the magnet. For example, in the case of a bonded magnet having a ring-like shape, it is desirable that a rack plating type or a barrel plating type is used. A known plating bath may be used such as a copper sulfate bath, a copper pyrophosphate bath and the like.

In carrying out an electroplating treatment on a film layer made of a fine Al powder, it is desirable that a zincate treatment is conducted in order to prevent the dissolution and flow-out of aluminum (Al) during the electroplating treatment. The zincate treatment may be carried out according to a known procedure, and the magnet may be immersed in a zincate solution containing, for example, sodium hydroxide, zinc oxide, ferric chloride, Rochelle salt and sodium sulfate for 10 seconds to 120 seconds at a bath temperature of 10° C. to 25° C.

In addition to the plated film, any one of various corrosion-resistant films, e.g. a metal oxide film or a chemical conversion coating film, can be formed on the film layer made of the fine metal powder. The formation of such a film can be achieved at a high thickness accuracy, because the film layer has been formed uniformly and firmly on the entire surface of the magnet.

To form the metal oxide film, any of known processes may be used such as a CVD process, a sputter coating process, a thermal decomposition coating process, a sol-gel coating process and the like. However, it is desirable to use a sol-gel coating process which comprises applying, to the surface of a magnet, a sol solution produced by the hydrolytic reaction and/or the polymerizing reaction of a metal compound which is a metal oxide film forming source, and subjecting the applied sol solution to a heat treatment, thereby forming a film. The sol solution used in the sol-gel coating process is relatively stable, and the formation of the film from the sol solution can be achieved at a relatively low temperature, leading to an advantage that it is possible to avoid an influence to the magnetic characteristic of the magnet itself due to a high temperature. And, particularly, the sol-gel coating process is effective for a bonded magnet made using a resin as a binder. The metal oxide film may be a film formed of a single metal oxide component, or a mixed oxide film formed of a plurality of metal oxide components. The metal oxide film exhibits an excellent corrosion resistance, if the thickness of the film is equal to or larger than 0.01 μm or less. The upper limit of the thickness of the metal oxide film is particularly not limited, but a thickness suitable for practical use is equal to or smaller than 10 μm, desirably, equal to or smaller than 5 μm from the demand for a reduction in size of the magnet itself. The formation of a metal oxide film containing the same metal component as the metal component forming the film layer (e.g., the formation of an Al-containing metal oxide film on a film layer made of a fine Al powder) is advantageous in respect of the fact that the adhesion at the interface between both of them is firm.

The sol solution used is a solution made by preparing a metal compound such as a metal alkoxide (in which some of alkoxyl groups maybe substituted by alkyl group or the like), a catalyst such as nitric acid, hydrochloric acid and the like, a stabilizer such as β-diketone if desired, and water in an organic solvent, so that a colloid produced by the hydrolytic reaction and/or the polymerizing reaction of the metal compound is dispersed in the solution. Fine inorganic particles may be also dispersed in the sol solution. Examples of methods for applying the sol solution are a dip coating process, a spraying process, a spin coating process and the like. It is desirable that the heat treatment after application of the sol solution is carried out at a temperature in a range of 80° C. to 200° C. in consideration of the boiling point of the organic solvent in the sol solution and the heat resistance of the magnet, particularly when a bonded magnet is applied. The time for the heat treatment is usually in a range of 1 minute to 1 hour. To produce a film having a desired thickness, the application and the heat treatment may be, of course, repeated.

To form the chemical conversion coating film, any of known processes may be used such as a chromate treatment, a phosphoric acid treatment, a zinc phosphatizing process, a manganese phosphatizing process, a calcium phosphatizing process, a zinc-calcium phosphatizing process, a titanium-phosphate type conversion coating process, a zirconium-phosphate type conversion coating process and the like. When the corrosion resistance of the film layer made of the fine Al powder is desired to be enhanced, the chromate treatment, the titanium-phosphate type conversion coating process and the zirconium-phosphate type conversion coating process are desirable. An especially desirable process is the titanium-phosphate type conversion coating process and the zirconium-phosphate type conversion coating process in which the load of a treating solution and the film to the environment is small.

A treating solution used to carry out a titanium-phosphate type conversion coating process is prepared by dissolving a titanium compound such as fluoro-titanate, phosphoric acid or condensed phosphoric acid, a fluorine compound such as fluoro-titanate and hydrofluoric acid. Examples of processes for applying the treating solution to the surface of the magnet are a dip coating process, a spraying process, a spin coating process and the like. It is desirable that the temperature of the treating solution, when it is applied to the surface, is in a range of 20° C. to 80° C., and the treating time is in a range of 10 seconds to 10 minutes. When the bonded magnet is used, the drying temperature for the treating solution, after it has been applied, is in a range of 50° C. to 200° C., and the drying time is in a range of 5 seconds to 1 hour. A zirconium-phosphate type conversion coating process may be carried out according to the same procedure as for the titanium-phosphate type conversion coating process. It is desirable that the formed film contains titanium or zirconium in an amount of 0.1 mg to 100 mg per the film portion formed on 1 $m^2$ of the surface of the magnet.

EXAMPLES

The detail of the present invention will now be described by way of particular examples. In the following examples, an electronic ray micro-analyzer (EPMA) (made under the trade name of EPM-810 by Shimadzu, Co.) was used for the measurement of the thickness of a film layer made of a fine metal powder. A fluorescent X-ray thickness meter (made under a trade name of SFT-7100by Seikou Electronics, Co.) was used for the measurement of the thickness of a plated film. A fluorescent X-ray strength measuring device (made under a trade name of RIX-3000 by Rigaku Denki, Co.) was used for the measurement of the content of a metal in a chemical conversion coating film.

Example 1

(Step A)

An epoxy resin was added in an amount of 2% by weight to an alloy powder made by a rapid solidification process and having an average particle size of 150 μm and a composition comprising 12% by atom of Nd, 77% by atom of Fe, 6% by atom of B and 5% by atom of Co, and the mixture was kneaded. The resulting material was subjected to a compression molding under a pressure of 686 $N/mm^2$ and then cured at 170° C. for 1 hour, thereby producing a ring-shaped bonded magnet having an out side diameter of 22 mm, an inside diameter of 20 mm and a height of 3 mm. The characteristics of the ring-shaped bonded magnet (blank) are shown in Table 1.

(Step B)

The fifty magnets produced at the step A (having an apparent volume of 0.15 l and a weight of 71 g) and 10 kg of a short columnar fine Cu powder producing material having a diameter of 1 mm and a length of 1 mm (made by cutting a wire) (having an apparent volume of 2 l) were thrown into a treating vessel in a vibrating-type barrel finishing machine having a volume of 3.5 l (in a total amount equal to 61% by volume of the internal volume of the treating vessel), where they were treated in a dry manner for 3 hours under conditions of a vibration frequency of 70 Hz and a vibration amplitude of 3 mm.

Particles in a fine Cu powder produced in the above operation had longer diameters in a range of a very small longer diameter of 0.1 μm or less to a largest longer diameter of about 5 μm.

The magnet produced in the above treatment was subjected to a Cu Kα-ray strength measurement using a standard sample. As a result, it was found that a film layer made of the fine Cu powder and having a thickness of 0.1 μm was formed on the magnetic powder on the surface of the magnet. Further, it was found that the resin portion on the surface of the magnet was coated with the film layer made of the fine Cu powder.

Example 2

The magnet produced in Example 1 and having the film layer made of the fine Cu powder on the entire surface of the magnet was washed and then subjected to an Ni electroplating treatment in a rack plating manner. This treatment was carried out using a plating solution having a composition comprising 240 g/l of nickel sulfate, 45 g/l of nickel chloride, an appropriate amount of nickel carbonate (having a pH value regulated) and 30 g/l of boric acid under conditions of a current density of 2 $A/dm^2$, a plating time of 60 minutes, a pH value of 4.2, a bath temperature of 55° C. A formed plated film had a thickness of 22 μm on the side of an outside diameter and a thickness of 20 μm on the side of an inside diameter.

The magnet having the plated film was subjected to an environment test (a humidity resistance test) for 500 hours under conditions of a temperature of 80° C. and a relative humidity of 90%. The observation of the situation of the surface by a microscope of 30 magnifications and the measurement of the rate of deterioration of the magnetic characteristic after the humidity resistance test were carried out. In addition, the dimensional accuracy of the thickness on the side of the inside diameter was measured (n=50). Results are shown in Tables 2 and 3.

As apparent from Tables. 2 and 3, the magnet having the plated film exhibited an excellent corrosion resistance, and was formed at a high thickness accuracy.

This result is believed to be attributable to the fact that the short columnar fine Cu powder producing material used in Example 1 is sharp and hence, the fine Cu powder having a fresh surface was produced efficiently by the collision of the short columnar fine Cu powder producing material against the contents of the treating vessel, and a fresh surface was produced efficiently even on the magnetic powder on the surface of the magnet, whereby the mechanochemical reaction could be caused very advantageously to form the firm and high-density film layer made of the fine Cu powder. The result is believed to be also attributable to the fact that the resin portion on the surface of the magnet could be coated with the film layer made of the fine Cu powder, whereby an electrically conductive layer could be formed uniformly and firmly on the entire surface of the magnet.

Example 3

(Step A)

An epoxy resin was added in an amount of 2% by weight to an alloy powder made by a rapid solidification process and having an average particle size of 150 μm and a composition comprising 13% by atom of Nd, 76% by atom of Fe, 6% by atom of B and 5% by atom of Co, and the mixture was kneaded. The resulting material was subjected to a compression molding under a pressure of 686 $N/mm^2$ and then cured at 180° C. for 2 hours, thereby producing a ring-shaped bonded magnet having an outside diameter of 21 mm, an inside diameter of 18 mm and a height of 4 mm. The characteristics of the ring-shaped bonded magnet (blank) are shown in Table 1.

(Step B)

The fifty magnets produced at the step A (having an apparent volume of 0.15 l and a weight of 132 g) and a short columnar fine Fe powder producing material having a diameter of 1 mm and a length of 0.8 mm (made by cutting a wire) (having an apparent volume of 2 l) were thrown into a treating vessel in a vibrating-type barrel finishing machine having a volume of 3.0 l (in a total amount equal to 72% by volume of the internal volume of the treating vessel), where they were treated in a dry manner for 2 hours under conditions of a vibration frequency of 60 Hz and a vibration amplitude of 2 mm.

Largest particles in a fine Fe powder produced in the above operation had a longer diameter of about 5 μm.

The magnet produced in the above treatment was subjected to a Fe Kα-ray strength measurement using a standard sample. As a result, it was found that a film layer made of the fine Fe powder and having a thickness of 0.1 μm was formed on the magnetic powder on the surface of the magnet. Further, it was found that the resin portion on the surface of the magnet was coated with the film layer made of the fine Fe powder.

Example 4

The magnet produced in Example 3 and having the film layer made of the fine Fe powder on the entire surface of the magnet was washed and then subjected to an Ni electroplating treatment in a rack plating manner. This treatment was carried out using a plating solution having a composition comprising 240 g/l of nickel sulfate, 45 g/l of nickel chloride, an appropriate amount of nickel carbonate (having a pH value regulated) and 30 g/l of boric acid under conditions of a current density of 2.2 $A/dm^2$, a plating time of 60 minutes, a pH value of4.2, a bath temperature of 50° C. A formed plated film had a thickness of 21 μm on the side of an outside diameter and a thickness of 18 μm on the side of an inside diameter.

The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 2 and 3, the magnet having the plated film exhibited an excellent corrosion resistance, and was formed at a high thickness accuracy.

Example 5

The treating operation was carried in the same manner as at the step B in Example 3, except that a ring-shaped bonded magnet (whose characteristics are shown in Table 1) made in the same manner as at the step A in Example 3 was used, and the short columnar fine Fe powder producing material used at the step B was replaced by a short columnar fine Ni powder producing material having the same size as the short columnar fine Fe powder producing material.

Largest particles in a fine Ni powder produced in the above operation had a longer diameter of about 5 μm.

The magnet produced in the above treatment was subjected to an Ni Kα-ray strength measurement using a standard sample. As a result, it was found that a film layer made of the fine Ni powder and having a thickness of 0.1 μm was formed on the magnetic powder on the surface of the magnet. Further, it was found that the resin portion on the surface of the magnet was coated with the film layer made of the fine Ni powder.

Example 6

The magnet produced in Example 5 and having the film layer made of the fine Ni powder on the entire surface of the magnet was subjected to an Ni electroplating treatment under the same conditions as in Example 4. The formed plated film had a thickness of 21 μm on the side of an outside diameter and a thickness of 18 μm on the side of an inside diameter.

The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 2 and 3, the magnet having the plated film exhibited an excellent corrosion resistance, and was formed at a high thickness accuracy.

Example 7

The treating operation was carried in the same manner as at the step B in Example 3, except that a ring-shaped bonded magnet (whose characteristics are shown in Table 1) made in the same manner as at the step A in Example 3 was used, and the short columnar fine Fe powder producing material used at the step B was replaced by a short columnar fine Co powder producing material having the same size as the short columnar fine Fe powder producing material.

Largest particles in a fine Co powder produced in the above operation had a longer diameter of about 5 μm.

The magnet produced in the above treatment was subjected to a Co Kα-ray strength measurement using a standard sample. As a result, it was found that a film layer made of the fine Co powder and having a thickness of 0.1 μm was formed on the magnetic powder on the surface of the magnet. Further, it was found that the resin portion on the surface of the magnet was coated with the film layer made of the fine Co powder.

Example 8

The magnet produced in Example 7 and having the film layer made of the fine Co powder on the entire surface of the magnet was subjected to an Ni electroplating treatment under the same conditions as in Example 4. The formed plated film had a thickness of 21 μm on the side of an outside diameter and a thickness of 18 μm on the side of an inside diameter.

The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 2 and 3, the magnet having the plated film exhibited an excellent corrosion resistance, and was formed at a high thickness accuracy.

Example 9

The treating operation was carried in the same manner as at the step B in Example 3, except that a ring-shaped bonded magnet (whose characteristics are shown in Table 1) made in the same manner as at the step A in Example 3 was used, and the short columnar fine Fe powder producing material used at the step B was replaced by a short columnar fine Cr powder producing material having the same size as the short columnar fine Fe powder producing material.

Largest particles in a fine Cr powder produced in the above operation had a longer diameter of about 5 μm.

The magnet produced in the above treatment was subjected to a Cr Kα-ray strength measurement using a standard sample. As a result, it was found that a film layer made of the fine Cr powder and having a thickness of 0.1 μm was formed on the magnetic powder on the surface of the magnet. Further, it was found that the resin portion on the surface of the magnet was coated with the film layer made of the fine Cr powder.

Example 10

The magnet produced in Example 9 and having the film layer made of the fine Cr powder on the entire surface of the magnet was subjected to an Ni electroplating treatment under the same conditions as in Example 4. The formed plated film had a thickness of 21 μm on the side of an outside diameter and a thickness of 18 μm on the side of an inside diameter.

The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 2 and 3, the magnet having the plated film exhibited an excellent corrosion resistance, and was formed at a high thickness accuracy.

Comparative Example 1

(Step A)

A ring-shaped bonded magnet made by the same manner as at the step A in Example 1 and having an outside diameter of 22 mm, an inside diameter of 20 mm and a height of 3 mm was washed, and an uncured phenol resin layer was then formed on the magnet in a dipping manner. Then, a commercially available Ag powder having a longer diameter of 0.7 μm or less was adhered to the surface of the resin. The fifty ring-shaped bonded magnets produced (having an apparent volume of 0.15 l and a weight of 71 g) were thrown into a treating vessel in a vibrating-type barrel finishing machine having a volume of 3.5, l where they were treated for 3 hours using steel balls having a diameter of 2.5 mm (having an apparent volume of 2 l) as media (in a total amount equal to 61% by volume of the internal volume of the treating vessel) and then subjected to a curing treatment at 150° C. for 2 hours, whereby an electrically conductive film layer having a thickness of 7 μm was formed on the surface of each of the magnets.

(Step B)

Each of the magnets produced at the step A was subjected to an Ni electroplating treatment under the same conditions as in Example 2. The magnet having the plated film was subjected to a humidity resistance test in the same manner as in Example 1, and the observation of the situation of the surface after the humidity resistance test and the measurement of the dimensional accuracy of the thickness on the side of the inside diameter were carried out in the same manner as in Example 1. As a result, as apparent from Table 2, each of the magnet having the plated film brought about a rusting by the humidity resistance test and had a lower thickness accuracy.

Comparative Example 2

(Step A)

A ring-shaped bonded magnet made by the same manner as at the step A in Example 1 and having an outside diameter of 22 mm, an inside diameter of 20 mm and a height of 3 mm was washed, and then immersed in a 10% (by weight) solution of an epoxy adhesive in methylethyl ketone (MEK) for 5 minutes and then hydro-extracted sufficiently. Thereafter, the MEK was dried. The fifty ring-shaped bonded magnets produced in the above manner and each having an uncured epoxy adhesive layer on its surface (having an apparent volume of 0.15 l and a weight of 71 g), 10 kg of Cu balls having a diameter of 1 mm (having an apparent volume of 2 l) and 25 g of a commercially available Cu powder having a longer diameter of 0.8 μm were thrown into a treating vessel in a vibrating-type barrel finishing machine having a volume of 3.5 l (in a total amount equal to 61% by volume of the internal volume of the treating vessel), where they were treated for 3 hours. Thereafter, the magnets were subjected to a curing treatment at 150° C. for 2 hours and then, the magnets were washed to remove the extra Cu powder, where by an electrically conductive film layer having a thickness of 18 μm was formed on the surface of each of the magnets.

(Step B)

Each of the magnets produced at the step A was subjected to an Ni electroplating treatment under the same conditions as in Example 2. The magnets having the plated film was subjected to a humidity resistance test in the same manner as in Example 1, and the observation of the situation of the surface after the humidity resistance test and the measurement of the dimensional accuracy of the thickness on the side of the inside diameter were carried out in the same manner as in Example 1. As a result, as apparent from Table 2, each of the magnets having the plated film brought about a rusting by the humidity resistance test and had a lower thickness accuracy.

TABLE 1

| | Blank | | |
|---|---|---|---|
| | Br (T) | HcJ (kA/m) | (BH) Max (kJ/m$^3$) |
| Example 1 | 0.67 | 708 | 71.6 |
| Example 3 | 0.68 | 724 | 73.2 |
| Example 5 | 0.68 | 724 | 73.2 |
| Example 7 | 0.68 | 724 | 73.2 |
| Example 9 | 0.68 | 724 | 73.2 |

TABLE 2

| | Situation of surface after humidity resistance test (observed by microscope of 30 magnifications) | Thickness accuracy ($\mu$m) | Producing manner |
|---|---|---|---|
| Example 2 | Not changed (not rusted) | 20 ± 1 | fine Cu powder coating + Ni plating |
| Example 4 | Not changed (not rusted) | 18 ± 2.5 | fine Fe powder coating + Ni plating |
| Example 6 | Not changed (not rusted) | 18 ± 2.5 | fine Ni powder coating + Ni plating |
| Example 8 | Not changed (not rusted) | 18 ± 2 | fine Co powder coating + Ni plating |
| Example 10 | Not changed (not rusted) | 18 ± 2 | fine Cr powder coating + Ni plating |
| Comparative Example 1 | partially rusted after 350 hours | 27 ± 10 | conductive film coating + Ni plating |
| Comparative Example 2 | partially rusted after 350 hours | 38 ± 8 | conductive film coating + Ni plating |

TABLE 3

| | Before humidity resistance test | | | After humidity resistance test | | | Rate (%) of deterioration of magnetic characteristic | | |
|---|---|---|---|---|---|---|---|---|---|
| | Br (T) | HcJ (kA/m) | (BH)Max (kJ/m$^3$) | Br (T) | HcJ (kA/m) | (BH)Max (kJ/m$^3$) | Br | HcJ | (BH)Max |
| Example 2 | 0.66 | 708 | 71.6 | 0.65 | 692 | 70.0 | 3.0 | 2.2 | 2.2 |
| Example 4 | 0.67 | 716 | 71.6 | 0.64 | 700 | 70.0 | 5.9 | 3.3 | 4.3 |
| Example 6 | 0.67 | 716 | 71.6 | 0.64 | 700 | 70.0 | 5.9 | 3.3 | 4.3 |
| Example 8 | 0.67 | 716 | 71.6 | 0.64 | 692 | 69.2 | 5.9 | 4.4 | 5.4 |
| Example 10 | 0.67 | 716 | 71.6 | 0.64 | 692 | 69.2 | 5.9 | 4.4 | 5.4 |

Rate of deterioration of magnetic characteristic (%) = (magnetic characteristic of blank) − (magnetic characteristic after humidity resistance test)/(magnetic characteristic of blank) × 100

Example 11

(Step A)

An epoxy resin was added in an amount of 2% by weight to an alloy powder made by a rapid solidification process and having an average particle size of 150 $\mu$m and a composition comprising 13% by atom of Nd, 76% by atom of Fe, 6% by atom of B and 5% by atom of Co, and the mixture was kneaded. The resulting material was subjected to a compression molding under a pressure of 686 N/mm$^2$ and then cured at 180° C. for 2 hours, thereby producing a ring-shaped bonded magnet having an outside diameter of 25 mm, an inside diameter of 23 mm and a height of 3 mm. The characteristics of the ring-shaped bonded magnet (blank) are shown in Table 4.

(Step B)

The fifty magnets produced at the step A (having an apparent volume of 0.15 l and a weight of 83 g) and a short columnar fine Sn powder producing material having a diameter of 2 mm and a length of 1 mm (made by cutting a wire) (having an apparent volume of 2 l) were thrown into a treating vessel in a vibrating-type barrel finishing machine having a volume of 3.0 l (in a total amount equal to 72% by volume of the internal volume of the treating vessel), where they were treated in a dry manner for 2 hours under conditions of a vibration frequency of 60 Hz and a vibration amplitude of 2 mm.

Particles in a fine Sn powder produced in the above operation had longer diameters in a range of a very small longer diameter of 0.1 $\mu$m or less to a largest longer diameter of about 5 $\mu$m.

The magnet produced in the above treatment was subjected to an Sn K$\alpha$-ray strength measurement using a standard sample. As a result, it was found that a film layer made of the fine Sn powder and having a thickness of 0.5 $\mu$m was formed on the magnetic powder on the surface of the magnet. Further, it was found that the resin portion on the surface of the magnet was coated with the film layer made of the fine Sn powder.

Example 12

The magnet produced in Example 11 and having the film layer made of the fine Sn powder on the entire surface of the magnet was washed and then subjected to a Cu electroplating treatment in a rack plating manner. This treatment was carried out using a plating solution having a composition comprising 20 g/l of copper and 10 g/l of free cyanogen under conditions of a current density of 2.3 A/dm$^2$, a plating time of 6 minutes, a pH value of 10.5, a bath temperature of 45° C. Then, the resulting magnet was subjected to an Ni electroplating treatment in a rack plating manner. This treatment was carried out using a plating solution having a composition comprising 240 g/l of nickel sulfate, 45 g/l of nickel chloride, an appropriate amount of nickel carbonate (having a pH value regulated) and 30 g/l of boric acid under conditions of a current density of 2.2 A/dm$^2$, a plating time of 60 minutes, a pH value of 4.2, a bath temperature of 50° C. A formed plated film had a thickness of 24 $\mu$m on the side of an outside diameter and a thickness of 22 $\mu$m on the side of an inside diameter.

The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 5 and 6, the magnet having the plated film exhibited an excellent corrosion resistance, and was formed at a high thickness accuracy.

Example 13

The treating operation was carried in the same manner as at the step B in Example 11, except that a ring-shaped bonded magnet (whose characteristics are shown in Table 4) made in the same manner as at the step A in Example 11 was used, and the short columnar fine Sn powder producing material used at the step B was replaced by a short columnar fine Zn powder producing material having the same size as the short columnar fine Sn powder producing material.

Largest particles in a fine Zn powder produced in the above operation had a longer diameter of about 5 μm.

The magnet produced in the above treatment was subjected to an Zn Kα-ray strength measurement using a standard sample. As a result, it was found that a film layer made of the fine Zn powder and having a thickness of 0.3 μm was formed on the magnetic powder on the surface of the magnet. Further, it was found that the resin portion on the surface of the magnet was coated with the film layer made of the fine Zn powder.

Example 14

The magnet produced in Example 13 and having the film layer made of the fine Zn powder on the entire surface of the magnet was subjected to a Cu electroplating treatment and an Ni electroplating treatment under the same conditions as in Example 12. The formed plated film had a thickness of 24 μm on the side of an outside diameter and a thickness of 22 μm on the side of an inside diameter.

The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 5 and 6, the magnet having the plated film exhibited an excellent corrosion resistance, and was formed at a high thickness accuracy.

Example 15

The treating operation was carried in the same manner as at the step B in Example 11, except that a ring-shaped bonded magnet (whose characteristics are shown in Table 4) made in the same manner as at the step A in Example 11 was used, and the short columnar fine Sn powder producing material used at the step B was replaced by a short columnar fine Pb powder producing material having the same size as the short columnar fine Sn powder producing material.

Largest particles in a fine Pb powder produced in the above operation had a longer diameter size of about 5 μm.

The magnet produced in the above treatment was subjected to a Pb Kα-ray strength measurement using a standard sample. As a result, it was found that a film layer made of the fine Pb powder and having a thickness of 0.7 μm was formed on the magnetic powder on the surface of the magnet. Further, it was found that the resin portion on the surface of the magnet was coated with the film layer made of the fine Pb powder.

Example 16

The magnet produced in Example 15 and having the film layer made of the fine Pb powder on the entire surface of the magnet was subjected to a Cu electroplating treatment and an Ni electroplating treatment under the same conditions as in Example 12. The formed plated film had a thickness of 24 μm on the side of an outside diameter and a thickness of 22 μm on the side of an inside diameter.

The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 5 and 6, the magnet having the plated film exhibited an excellent corrosion resistance, and was formed at a high thickness accuracy.

Comparative Example 3

(Step A)

A ring-shaped bonded magnet (whose characteristics are shown in Table 4) made by the same manner as at the step A in Example 11 and having an outside diameter of 25 mm, an inside diameter of 23 mm and a height of 3 mm was washed, and a uncured phenol resin layer was then formed on the magnet in a dipping manner. Then, a commercially available Ag powder having a longer diameter of 0.8 μm or less was adhered to the surface of the resin. The fifty ring-shaped bonded magnets produced (having an apparent volume of 0.15 l and a weight of 83 g) were thrown into a treating vessel in a vibrating-type barrel finishing machine having a volume of 3.0, l where they were treated for 2 hours using steel balls having a diameter of 2.5 mm (having an apparent volume of 2 l) as media (in a total amount equal to 72% by volume of the internal volume of the treating vessel) and then subjected to a curing treatment at 150° C. for 2 hours, whereby an electrically conductive film layer having a thickness of 8 μm was formed on the surface of each of the magnets.

(Step B)

Each of the magnets produced at the step A was subjected to a Cu electroplating treatment and an Ni electroplating treatment under the same conditions as in Example 12. The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 5 and 6, each of the magnets having the plated film brought about a rusting and the deterioration of the magnetic characteristic by the humidity resistance test and had a lower thickness accuracy.

TABLE 4

| | Blank | | |
|---|---|---|---|
| | Br (T) | HcJ (kA/m) | (BH) Max (kJ/m$^3$) |
| Example 11 | 0.69 | 724 | 74.0 |
| Example 13 | 0.69 | 724 | 74.0 |
| Example 15 | 0.69 | 724 | 74.0 |
| Comparative Example 3 | 0.69 | 724 | 74.0 |

TABLE 5

| | Situation of surface after humidity resistance test (observed by microscope of 30 magnifications) | Thickness accuracy ($\mu$m) | Producing manner |
|---|---|---|---|
| Example 12 | not changed (not rusted) | 22 ± 1.5 | fine Sn powder coating + Cu plating + Ni plating |
| Example 14 | not changed (not rusted) | 22 ± 1.5 | fine Zn powder coating + Cu plating + Ni plating |
| Example 16 | not changed (not rusted) | 22 ± 1.5 | fine Pb powder coating + Cu plating + Ni plating |
| Comparative Example 3 | partially rusted after 330 hours | 28 ± 11 | conductive film coating + Cu plating + Ni plating |

TABLE 6

| | Before humidity resistance test | | | After humidity resistance test | | | Rate (%) of deterioration of magnetic characteristic | | |
|---|---|---|---|---|---|---|---|---|---|
| | Br (T) | HcJ (kA/m) | (BH)Max (kJ/m$^3$) | Br (T) | HcJ (kA/m) | (BH)Max (kJ/m$^3$) | Br | HcJ | (BH)Max |
| Example 12 | 0.66 | 716 | 72.4 | 0.67 | 708 | 71.6 | 2.9 | 2.2 | 3.2 |
| Example 14 | 0.66 | 716 | 72.4 | 0.67 | 700 | 71.6 | 2.9 | 3.3 | 3.2 |
| Example 16 | 0.68 | 716 | 72.4 | 0.66 | 700 | 70.8 | 4.3 | 3.3 | 4.3 |
| Comparative Example 3 | 0.68 | 700 | 70.8 | 0.61 | 676 | 66.8 | 11.6 | 6.6 | 9.7 |

Rate of deterioration of magnetic characteristic (%) = (magnetic characteristic of blank) − (magnetic characteristic after humidity resistance test)/(magnetic characteristic of blank) × 100

Example 17

(Step A)

An epoxy resin was added in an amount of 2% by weight to an alloy powder made by a rapid solidification process and having an average particle size of 150 $\mu$m and a composition comprising 13% by atom of Nd, 76% by atom of Fe, 6% by atom of B and 5% by atom of Co, and the mixture was kneaded. The resulting material was subjected to a compression molding under a pressure of 686 N/mm$^2$ and then cured at 180° C. for 2 hours, thereby producing a ring-shaped bonded magnet having an outside diameter of 20 mm, an inside diameter of 17 mm and a height of 6 mm. The characteristics of the ring-shaped bonded magnet (blank) are shown in Table 7.

(Step B)

The fifty magnets produced at the step A (having an apparent volume of 0.15 l and a weight of 188 g) and a short columnar fine Al powder producing material having a diameter of 1.2 mm and a length of 1.5 mm (made by cutting a wire) (having an apparent volume of 2 l) were thrown into a treating vessel in a vibrating-type barrel finishing machine having a volume of 3.0 l (in a total amount equal to 72% by volume of the internal volume of the treating vessel), where they were treated in a dry manner for 2 hours under conditions of a vibration frequency of 60 Hz and a vibration amplitude of 2 mm.

Largest particles in a fine Al powder produced in the above operation had a longer diameter of about 5 $\mu$m.

The magnet produced by the above treatment was subjected to an Al K$\alpha$-ray strength measurement using a standard sample. As a result, it was found that a film layer made of the fine Al powder and having a thickness of 0.4 $\mu$m was formed on the magnetic powder on the surface of the magnet. Further, it was found that the resin portion on the surface of the magnet was coated with the film layer made of the fine Al powder.

Even if the magnet having the film layer made of the fine Al powder on the entire surface of the magnet was left to stand under conditions of a temperature of 80° C. and a relative humidity of 90%, a rusting was not brought about before a lapse of 36 hours (as a result of the observation of the situation of the surface using a microscope of 30 magnifications).

Example 18

The magnet produced in Example 17 and having the film layer made of the fine Al powder on the entire surface of the magnet immersed in a zincate solution having a composition comprising 50 g/l of sodium hydroxide, 5 g/l of zinc oxide, 2 g/l of ferric chloride, 50 g/l of Rochelle salt and 1 g/l of sodium nitrate at a bath temperature of 20° C. for 1 minute to conduct a zincate treatment. The resulting magnet was washed and then subjected to an Ni electroplating treatment in a rack plating manner. This treatment was carried out using a plating solution having a composition comprising 240 g/l of nickel sulfate, 45 g/l of nickel chloride, an appropriate amount of nickel carbonate (having a pH value regulated) and 30 g/l of boric acid under conditions of a current density of 2.2 A/dm$^2$, a plating time of 60 minutes, a pH value of 4.2 and a bath temperature of 50° C. A formed plated film had a thickness of 21 $\mu$m on the side of an outside diameter and a thickness of 19 $\mu$m on the side of an inside diameter.

The magnet having the plated film was subjected to a humidity resistance test in the same manner as in Example 1. The observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 8 and 9, the magnet having the plated film exhibited an excellent corrosion resistance, and was formed at a high thickness accuracy.

Comparative Example 4

(Step A)

A ring-shaped bonded magnet (whose characteristics are shown in Table 7) made by the same manner as at the step A in Example 17 and having an outside diameter of 20 mm, an inside diameter of 17 mm and a height of 6 mm was washed, and an uncured phenol resin layer was then formed on the magnet in a dipping manner. Then, a commercially available Ag powder having a longer diameter of 0.8 μm or less was adhered to the surface of the resin. The fifty ring-shaped bonded magnets produced (having an apparent volume of 0.15 l and a weight of 188 g) were thrown into a treating vessel in a vibrating-type barrel finishing machine having a volume of 3.0, l where they were treated for 2 hours using steel balls having a diameter of 2.5 mm (having an apparent volume of 2 l) as media (in a total amount equal to 72% by volume of the internal volume of the treating vessel) and then subjected to a curing treatment at 150° C. for 2 hours, whereby an electrically conductive film layer having a thickness of 7 μm was formed on the surface of each of the magnets.

TABLE 7

| | Blank | | |
|---|---|---|---|
| | Br (T) | HcJ (kA/m) | (BH) Max (kJ/m$^3$) |
| Example 17 | 0.69 | 748 | 76.4 |
| Comparative Example 4 | 0.69 | 748 | 76.4 |

TABLE 8

| | Situation of surface after humidity resistance test (observed by microscope of 30 magnifications) | Thickness accuracy (μm) | Producing manner |
|---|---|---|---|
| Example 18 | not changed (not rusted) | 20 ± 2.5 | fine Al powder coating + zincate treatment + Ni plating |
| Comparative Example 4 | partially rusted after 300 hours | 26 ± 11 | conductive film coating + Ni plating |

TABLE 9

| | Before humidity resistance test | | | After humidity resistance test | | | Rate (%) of deterioration of magnetic characteristic | | |
|---|---|---|---|---|---|---|---|---|---|
| | Br (T) | HcJ (kA/m) | (BH)Max (kJ/m$^3$) | Br (T) | HcJ (kA/m) | (BH)Max (kJ/m$^3$) | Br | HcJ | (BH)Max |
| Example 18 | 0.68 | 732 | 74.8 | 0.66 | 708 | 72.4 | 4.3 | 5.3 | 5.2 |
| Comparative Example 4 | 0.66 | 716 | 73.2 | 0.61 | 684 | 68.4 | 11.6 | 8.5 | 10.4 |

Rate of deterioration of magnetic characteristic (%) = (magnetic characteristic of blank) − (magnetic characteristic after humidity resistance test)/(magnetic characteristic of blank) × 100

(Step B)

Each of the magnets produced at the step A was subjected to an Ni electroplating treatment under the same conditions as in Example 18. The magnet having the plated film was subjected to a humidity resistance test in the same manner as in Example 1, and the observation of the situation of the surface and the measurement of the rate of deterioration of the magnetic characteristic after the humidity resistance test were carried out in the same manner as in Example 1. Further, the dimensional accuracy of the thickness on the side of the inside diameter was measured in the same manner as in Example 1. As a result, as apparent from Tables 8 and 9, each of the magnets having the plated film brought about a rusting and the deterioration of the magnetic characteristic by the humidity resistance test and had a lower thickness accuracy.

Example 19

(Step A)

An epoxy resin was added in an amount of 2% by weight to an alloy powder made by a rapid solidification process and having an average particle size of 150 μm and a composition comprising 12% by atom of Nd, 77% by atom of Fe, 6% by atom of B and 5% by atom of Co, and the mixture was kneaded. The resulting material was subjected to a compression molding under a pressure of 686 N/mm$^2$ and then cured at 170° C. for 1 hour, thereby producing a ring-shaped bonded magnet having a length of 30 mm, a width of 20 mm and a height of 3 mm.

The magnet was left to stand under conditions of a temperature of 80° C. and a relative humidity of 90%, and after a lapse of 12 hours, very small spot rusts were generated in the magnet (as a result of the observation of the situation of the surface using a microscope of 30 magnifications).

(Step B)

The fifty magnets produced at the step A (having an apparent volume of 0.1 l and a weight of 650 g) and a short columnar fine Sn powder producing material having a diameter of 2 mm and a length of 1 mm (made by cutting a wire) (having an apparent volume of 2 l) were thrown into a treating vessel in a vibrating-type barrel finishing machine having a volume of 3.0 l (in a total amount equal to 72% by volume of the internal volume of the treating vessel), where they were treated in a dry manner for 2 hours under conditions of a vibration frequency of 60 Hz and a vibration amplitude of 2 mm.

Particles in a fine Sn powder produced in the above operation had longer diameters in a range of a very small longer diameter of 0.1 μm or less to a largest longer diameter of about 5 μm.

The magnet produced in the above treatment was subjected to an Sn Kα-ray strength measurement using a standard sample. As a result, it was found that a film layer made of the fine Sn powder and having a thickness of 0.5 μm was formed on the magnetic powder on the surface of the magnet. Further, it was found that the resin portion on the surface of the magnet was coated with the film layer made of the fine Sn powder.

Example 20

A sol solution was prepared at a composition, a viscosity and a pH value shown in Table 11 from an Si compound, a catalyst, an organic solvent and water shown in Table 10. The sol solution was applied at a pulling rate shown in Table 12 by a dip coating process to the magnet made in Example 19 and having the film layer made of the fine Sn powder on the entire surface of the magnet. And then, the magnet was subjected to a heat treatment shown in Table 12, thereby forming an Si oxide film (an $SiO_x$ film, wherein $0<x\leqq 2$) having a thickness of 1.5 μm (measured by the observation of a broken surface using an electron microscope) on the surface of the magnet.

Even if the magnet having the Si oxide film formed by the sol-gel coating process was left to stand under conditions of a temperature of 80° C. and a relative humidity of 90%, a rusting was not brought about before a lapse of 200 hours (as a result of the observation of the situation of the surface using a microscope of 30 magnifications).

Example 21

The treating operation was carried in the same manner as at the step B in Example 19, except that a bonded magnet made in the same manner as at the step A in Example 19 was used, and the short columnar fine Sn powder producing material used at the step B was replaced by a short columnar fine Zn powder producing material having the same size as the short columnar fine Sn powder producing material.

Largest particles in a fine Zn powder produced in the above operation had a longer diameter of about 5 μm.

The magnet produced in the above treatment was subjected to a Zn Kα-ray strength measurement using a standard sample. As a result, it was found that a film layer made of the fine Zn powder and having a thickness of 0.3 μm was formed on the magnetic powder on the surface of the magnet. Further, it was found that the resin portion on the surface of the magnet was coated with the film layer made of the fine Zn powder.

Example 22

A sol solution was prepared at a composition, a viscosity and a pH value shown in Table 11 from a Ti compound, a catalyst, a stabilizer, an organic solvent and water shown in Table 10. The sol solution was applied at a pulling rate shown in Table 12 by a dip coating process to the magnet made in Example 21 and having the film layer made of the fine Zn powder on the entire surface of the magnet. And then, the magnet was subjected to a heat treatment shown in Table 12, thereby forming a Ti oxide film (an $TiO_x$ film, wherein $0<x\leqq 2$) having a thickness of 0.7 μm (measured by the observation of a broken surface using an electron microscope) on the surface of the magnet.

Even if the magnet having the Ti oxide film formed by the sol-gel coating process was left to stand under conditions of a temperature of 80° C. and a relative humidity of 90%, a rusting was not brought about before a lapse of 200 hours (as a result of the observation of the situation of the surface using a microscope of 30 magnifications).

Example 23

Fifty magnets produced in the same manner as at the step A in Example 19 (having an apparent volume of 0.1 l and a weight of 650 g) and a short columnar fine Al powder producing material having a diameter of 1.2 mm and a length of 1.5 mm (made by cutting a wire) (having an apparent volume of 2 l) were thrown into a treating vessel in a vibrating-type barrel finishing machine having a volume of 3.0 l (in a total amount equal to 72% by volume of the internal volume of the treating vessel), where they were treated in a dry manner for 2 hours under conditions of a vibration frequency of 60 Hz and a vibration amplitude of 2 mm.

Particles in a fine Al powder produced in the above operation had longer diameters in a range of a very small longer diameter of 0.1 μm or less to a largest longer diameter of about 5 μm.

The magnet produced in the above treatment was subjected to an Al Kα-ray strength measurement using a standard sample. As a result, it was found that a film layer made of the fine Al powder and having a thickness of 0.4 μm was formed on the magnetic powder on the surface of the magnet. Further, it was found that the resin portion on the surface of the magnet was coated with the film layer made of the fine Al powder.

Example 24

A sol solution was prepared at a composition, a viscosity and a pH value shown in Table 11 from an Si compound, an Al compound, a catalyst, a stabilizer, an organic solvent and water shown in Table 10. The sol solution was applied at a pulling rate shown in Table 12 by a dip coating process to the magnet made in Example 23 and having the film layer made of the fine Al powder on the entire surface of the magnet. And then, the magnet was subjected to a heat treatment shown in Table 12, thereby forming an Si—Al mixed oxide film (an $SiO_x.Al_2O_y$ film, wherein $0<x\leqq 2$ and $0<y\leqq 3$) having a thickness of 0.5 μm (measured by the observation of a broken surface using an electron microscope) on the surface of the magnet.

Even if the magnet having the Si—Al mixed oxide film formed by the sol-gel coating process was left to stand under conditions of a temperature of 80° C. and a relative humidity of 90%, a rusting was not brought about before a lapse of 200 hours (as a result of the observation of the situation of the surface using a microscope of 30 magnifications).

TABLE 10

| | Metal compound | Catalyst | Stabilizer | Organic solvent |
|---|---|---|---|---|
| Example 20 | tetramethoxy silane | nitric acid | not used | ethanol |
| Example 22 | titanium butoxide | hydrochloric acid | acetylacetone | ethanol + IPA |
| Example 24 | tetraethoxy silane + aluminum butoxide | acetic acid | not used | ethanol + IPA |

IPA = isopropyl alcohol

TABLE 11

| | Proportion of M compound (% by mass) | Molar ratio Catalyst/M compound | Stabilizer/M compound | Water/M compound | Viscosity (cP) | pH |
|---|---|---|---|---|---|---|
| Example 20 | 10 (in terms of $SiO_2$) | 0.001 | 0 | 1 | 1.8 | 3.2 |
| Example 22 | 5 (in terms of $TiO_2$) | 0.005 | 1.5 | 3 | 1.8 | 2.6 |
| Example 24 | 5 (in terms of $SiO_2$ + $Al_2O_3$) | 2 | 0 | 5 | 1.5 | 4.1 |

Note: M compound = metal compound
Al/(Si + Al) in Example 24 = 0.1 (molar ratio)

TABLE 12

| | Pulling rate (cm/min) | Heat treatment | Note |
|---|---|---|---|
| Example 20 | 5 | 100° C. × 20 min | (pulling-up → heat treatment) × 5 |
| Example 22 | 10 | 150° C. × 20 min | (pulling-up → heat treatment) × 5 |
| Example 24 | 5 | 150° C. × 20 min | (pulling-up → heat treatment) × 5 |

Example 25

The magnet produced in Example 17 and having the film layer made of the fine Al powder on the entire surface of the magnet was immersed for 1 minute at a bath temperature of 40° C. in a treating solution (having a pH value of 3.8) prepared by dissolving 35 g of PALCOAT 3753 (which is a trade name and which is a Ti-phosphate chemical conversion treating agent made by Nihon Parkerizing, Co.) into 1 l of water. Then, the resulting magnet was dried at 100° C. for 20 minutes, whereby a Ti-containing chemical conversion coating film was formed on the surface of the magnet. The content of Ti in the formed film was 10 mg per the film portion formed on 1 $m^2$ of the surface of the magnet.

Even if the magnet having the chemical conversion coating film was left to stand under conditions of a temperature of 80° C. and a relative humidity of 90%, a rusting was not brought about before a lapse of 200 hours (as a result of the observation of the situation of the surface using a microscope of 30 magnifications).

Example 26

The magnet produced in Example 17 and having the film layer made of the fine Al powder on the entire surface of the magnet was immersed for 1.5 minutes at a bath temperature of 50° C. in a treating solution (having a pH value of 3.2) prepared by dissolving 10 g of PALCOAT 3756MA and 10 g of PALCOAT 3756MB (each of which is a trade name and both of which are Zr-phosphate chemical conversion treating agents made by Nihon Parkerizing, Co.) into 1 l of water. Then, the resulting magnet was dried at 120° C. for 20 minutes, whereby a Zr-containing chemical conversion coating film was formed on the surface of the magnet. The content of Zr in the formed film was 16 mg per the film portion formed on 1 $m^2$ of the surface of the magnet.

Even if the magnet having the chemical conversion coating film was left to stand under conditions of a temperature of 80° C. and a relative humidity of 90%, a rusting was not brought about before a lapse of 200 hours (as a result of the observation of the situation of the surface using a microscope of 30 magnifications).

Example 27

(Step A)

A sintered magnet having a composition of 17Nd-1Pr-75Fe-7B and a size of 23 mm×10 mm×6 mm was made by finely pulverizing a known cast ingot and then subjecting the pulverized material to a pressing, a sintering, a heat treatment and a surface working, for example, in a manner as described in U.S. Pat. No. 4,770,723.

The magnet was left to stand under conditions of a temperature of 80° C. and a relative humidity of 90%, and spot rusts were gene rated after a lapse of 6 hours (as a result of the observation of the situation of the surface using a microscope of 30 magnifications).

(Step B)

The thirty magnets produced at the step A (having an apparent volume of 0.1 and a weight of 320 g) and a short columnar fine Al powder producing material having a diameter of 0.8 mm and a length of 1 mm (made by cutting a wire) (having an apparent volume of 2 l) were thrown into a treating vessel in a vibrating-type barrel finishing machine having a volume of 3.5 l (in a total amount equal to 60% by volume of the internal volume of the treating vessel), where they were treated in a dry manner for 5 hours under conditions of a vibration frequency of 60 Hz and a vibration amplitude of 1.5 mm.

Particles in a fine Al powder produced in the above operation had longer diameters in a range of a very small longer diameter of 0.1 $\mu$m or less to a largest longer diameter of about 5 $\mu$m.

The magnet produced in the above treatment was subjected to an Al K$\alpha$-ray strength measurement using a standard sample. As a result, it was found that a film layer made of the fine Al powder and having a thickness of 0.6 $\mu$m was formed on the surface of the magnet.

Even if the magnet having the film layer made of the fine Al powder on the entire surface of the magnet was left to stand under conditions of a temperature of 80° C. and a relative humidity of 90%, a rusting was not brought about before a lapse of 24 hours (as a result of the observation of the situation of the surface using a microscope of 30 magnifications).

What is claimed is:

1. A process for producing a rare earth metal-based permanent magnet, comprising the steps of:

(a) placing into a treating vessel a rare earth metal-based permanent magnet having a surface comprising a metal, and pieces of metallic material, and (b) vibrating and/or agitating in said treating vessel both of said permanent magnet and said pieces of metallic material, to cause collision wherein, upon collision of the permanent magnet and the pieces of metallic material, a fine metal powder is freshly produced from said pieces of metallic material and the thus freshly produced fine metal powder forms a film layer adhered directly on the metal forming the surface of said magnet as a result of the fine metal powder being freshly produced.

2. A process for producing a rare earth metal-based permanent magnet according to claim 1, wherein said treating vessel is a treating vessel in a barrel finishing machine.

3. A process for producing a rare earth metal-based permanent magnet according to claim 1, wherein the treatment is carried out in a dry manner.

4. A process for producing a rare earth metal-based permanent magnet according to claim 1, wherein said pieces of metallic material are of a needle-like shape and/or a columnar shape, each of said pieces having a maximum diameter in a range of 0.05 mm to 10 mm.

* * * * *